US009375778B2

(12) United States Patent
Bachmann

(10) Patent No.: US 9,375,778 B2
(45) Date of Patent: Jun. 28, 2016

(54) METHOD FOR FORMING FORGED PARTS

(71) Applicant: CDP Bharat Forge GmbH, Ennepetal (DE)

(72) Inventor: Markus Bachmann, Ennepetal (DE)

(73) Assignee: CDP Bharat Forge GmbH, Ennepetal (DE)

( * ) Notice: Subject to any disclaimer, the term of this patent is extended or adjusted under 35 U.S.C. 154(b) by 0 days.

(21) Appl. No.: 14/365,130

(22) PCT Filed: Dec. 17, 2012

(86) PCT No.: PCT/EP2012/075757

§ 371 (c)(1),
(2) Date: Sep. 9, 2014

(87) PCT Pub. No.: WO2013/087924

PCT Pub. Date: Jun. 20, 2013

(65) Prior Publication Data

US 2015/0013408 A1 Jan. 15, 2015

(30) Foreign Application Priority Data

Dec. 16, 2011 (DE) ..... 10 2011 088 862

(51) Int. Cl.

| | |
|---|---|
| ***B21J 5/00*** | (2006.01) |
| ***B21J 5/02*** | (2006.01) |
| ***B21J 9/02*** | (2006.01) |
| ***B21K 1/12*** | (2006.01) |
| ***B21J 13/00*** | (2006.01) |

(52) U.S. Cl.
CPC .. *B21J 5/008* (2013.01); *B21J 5/02* (2013.01); *B21J 5/025* (2013.01); *B21J 9/027* (2013.01); *B21J 13/00* (2013.01); *B21K 1/12* (2013.01)

(58) Field of Classification Search
CPC ..... B21J 5/02; B21J 5/025; B21J 5/027; B21J 5/10; B21J 13/02; B21J 13/025; B21J 5/008; B21K 1/26; B21K 1/762
See application file for complete search history.

(56) References Cited

U.S. PATENT DOCUMENTS

| | | | | |
|---|---|---|---|---|
| 4,910,990 | A * | 3/1990 | Delio | 72/356 |
| 5,544,413 | A * | 8/1996 | Stevens et al. | 29/888.092 |
| 6,427,326 | B1 | 8/2002 | Soga et al. | |
| 6,530,149 | B2 * | 3/2003 | Sugiura et al. | 29/888.042 |

FOREIGN PATENT DOCUMENTS

| | | | |
|---|---|---|---|
| EP | 0 015 648 | A1 | 9/1980 |
| EP | 1 134 412 | A2 | 9/2001 |
| WO | WO 95/34853 | A1 | 12/1995 |

* cited by examiner

*Primary Examiner* — Debra Sullivan
(74) *Attorney, Agent, or Firm* — Wolf, Greenfield & Sacks, P.C.

(57) ABSTRACT

A method according to the invention for producing forged parts with a prescribed end contour comprises the following steps: pre-forging of a blank in order to obtain a forged part and subsequent reshaping of the forged part in a die, wherein one or a plurality of tools are inserted into the forged part during the reshaping and, in the process, the material of the forged part is displaced in a manner such that the specified end contour is obtained.

6 Claims, 5 Drawing Sheets

Compressing

Pre-pressing

Pre-forging I

Pre-forging II

Hot straightening

20
Compressing

Pre-pressing

Pre-forging I

Pre-forging II

20′
Hollow-punch piercing

20″
Deburning/Hot straightening

20‴

METHOD FOR FORMING FORGED PARTS

TECHNICAL FIELD

The present invention relates to a method for forming forged parts, in particular for the formation of so-called secondary formed elements on the forged parts. Examples of such forged parts are, for example, steering knuckles for commercial vehicles.

PRIOR ART

In the automotive industry as well as generally in the field of transport and commercial vehicles (that is, for example, cars, trucks, construction vehicles, trains), highly stressed forged components having complex geometries are being increasingly employed. At the same time, the requirements for the precision of the components have also increased. When producing such forged parts, such as, for example, the steering knuckles for commercial vehicles mentioned at the outset, in the current prior art a raw part is first generated by forging, which after deburring is again mechanically reworked, that is by machining, to form desired features such as bearing seats with the necessary precision and to thus arrive at the finished product. By this mechanical reworking, however, the processing times for the forged part are extended on the one hand and, on the other hand, owing to the material removal by means of subsequent machining, the raw material portion required for the finished product is increased. Both aspects lead to a not insignificant cost increase as well as an increased environmental impact. While it would be conceivable from a material-saving point of view to cast such components, cast products, however, have clear disadvantages with regard to material solidity and load capacity as compared to forged products, which can be of great significance in particular with highly stressed components such as said steering knuckles for commercial vehicles.

PRESENTATION OF INVENTION

Starting with this problem, one object of the invention is to provide a method for producing forged parts, which without forfeiting fabrication accuracy reduces the weight of the component used and decreases the weight of the raw part, and thereby as a whole simultaneously reduces fabrication times.

According to the present invention, the method for producing forged parts having a pre-given end contour comprises the following steps: pre-forging a blank in order to obtain a forged part and subsequent forming of the forged part in a die, one or plural tools are being inserted during forming into the forged part and, in the process, the material of the forged part being displaced in a manner such that the pre-given end contour is obtained.

Within the meaning of the invention, the end contour is to be understood as the shape of the surface of the finished forged part (prior to potential fine machining such as deburring or hot straightening), therefore it also comprises recesses, notches, undercuts and the like. In contrast, the outer contour is to be considered a part of the surface of the forged part generally directed outward away from the forged part and thus, for example, does not comprise any undercuts, notches or the like. With conventional forging, the outer contour is determined by the shape of the inner surfaces of the forging die. In the case of the present invention, during pre-forging preferably a half-finished or nearly finished forged part is obtained having a smaller outer contour as compared to the end contour. Pre-forging can consist of one, but also two or multiple, forging steps, by means of which the end contour of the forged part is approximated.

By the forming according to the invention, it is possible to produce the blank using less material since to obtain the end contour, mechanical and/or machine finishing is not necessary. A potential reworking can thus, to save time, be focused on the precise procurement of the dimensions, which is why it is only necessary to remove a minimal amount of material (for example in the form of deburring) so that on the one hand the portion of raw material on the finished product decreases and on the other hand a considerable amount of time can be saved during production. Further, owing to the lower weight of the raw part as well as the lower material weight (volume) of the forged part, savings can be made during transportation both within the factory and also subsequently during delivery. All of this has a positive effect not only on the production costs but it also contributes to production having a lower environmental impact. By inserting the tool or tools into the forged part and the corresponding material displacement, the die is also filled in an optimal manner "from the inside", which leads to essentially less waste by incomplete filling of the die. In other words, providing the step of forming, that is an additional step compared to the prior art, yields benefits both with regard to profitability as well as process stability.

It is furthermore an advantage that by forming and in particular inserting the tool/tools, material is displaced and thus the fiber orientation of the material parallel to the surfaces (of the end contour) is maintained. In this way, the finished forged part is given an increased solidity in particular at the edges and bends as well as other more complicated geometric features of the surface of the forged part, for example bearing seats.

Here, it is preferred that at the beginning of forming slightly more material is available in the die than is necessary volume-wise for the final forged part (which is defined by the pre-given end contour), and thus by inserting the tool/tools during forming, the material also flows into the burrs at the edges of the die. Additional process security is thereby established with regard to the complete filling of the die.

Preferably, the tool which is inserted into the forged part during forming is a punch (mandrel) or hollow punch (hollow mandrel). By the use of a punch or hollow punch, high forming forces can be applied, which lead to efficient material displacement during forming and a complete filling of the die. A hollow punch additionally enables a particularly precise shaping of the forged part at the point of insertion and can thus be employed particularly effectively to determine the end contour.

According to a preferred embodiment, secondary formed elements of the finished forged part are formed by the tool and/or tools. Secondary formed elements within the meaning of the present application are shape features of the forged part surface, which cannot be produced or only with difficulty with forging by dies (die halves moved against each other), for example the seats for bearing shells on truck steering knuckles. In particular the formation of secondary formed elements necessitated in the prior art material-removing machining processes which not only increased the material used but also extended the processing times. By forming such secondary formed elements by means of the tool/tools, a great deal of material and accordingly time can be saved.

In a particularly preferred embodiment, the forming is essentially carried out at the temperature of the preceding pre-forging step. Here it is advantageous that owing to the high temperatures still from the forging process, an essentially power-saving forming is possible and at the same time no additional energy is required to heat the forged part for forming.

It is furthermore advantageous that the forming direction/directions determined by the tool/tools is/are essentially perpendicular to the closing direction of the die. During forming, the pre-forged blank is deposited into the die and the die is closed. By inserting the tools in said forming direction essentially perpendicular to the closing direction of the die, the material displaced towards the sides of the tool can thus in an almost ideal manner fill in the die cavity determined by the die. This die cavity preferably defines the outer contour of the pre-given end contour, in other words the die determines the position of the surfaces of the finished forged part essentially directed outward, whereas recesses, notches, or similar secondary formed elements can be defined by the tools (for example hollow punches). This also contributes to the efficient filling of the die and in this way avoids excessive use of materials.

Finally, it is particularly advantageous to subject the forged part after forming to a deburring or hot straightening step. In this way, the warping behaviour of the forged part as a result of the hollow punch can be efficiently compensated without the need to remove a large amount of material or use a great deal of effort to hot straighten, with the precision of fabrication consistently being improved together with consistent minimal use of materials and short processing times.

BRIEF DESCRIPTION OF THE DRAWINGS

A preferred embodiment of the method according to the invention is explained hereinafter as an example by means of the accompanying drawings.

DETAILED DESCRIPTION

FIG. 1 schematically shows the course of a production procedure of a truck steering knuckle according to the prior art. A blank 10 made of steel is first compressed, pre-pressed and subjected to a first step of pre-forging (FIGS. 1*a* to *c*), the essential outer geometry of the component being formed being produced. During the subsequent second pre-forging step (FIG. 1*d*), the detailed outer contours of this intermediate product 10' are produced by the die (but not larger than the pre-given end contour). In the final deburring or hot straightening step (FIG. 1*e*), the excess forging material is then removed such that the forged finished product 10" is obtained. Since by means of the forging process, however, no complicated three-dimensional contours can be formed, such as, for example, lateral notches for bearing shells, the completed forged part 10" must still be mechanically reworked, that is by machining. The excess material accumulated during reworking thus increases the raw material portion on the finished product, which in addition to the processing times required therefor also increases the production costs and moreover causes a greater environmental impact.

Figure 1A:
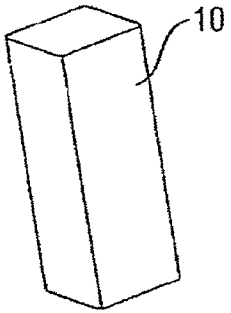
Fig. 1a (Prior Art)
FIG. 1 schematically shows, using the example of a steering knuckle, a production method according to the prior art.
Figure 1B:
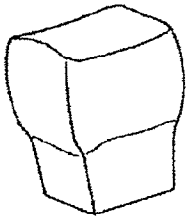
Fig. 1b (Prior Art)
Figure 1C:
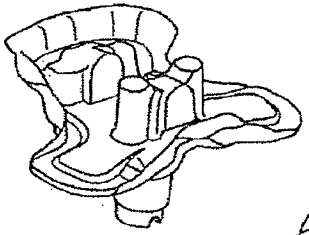
Fig. 1c (Prior Art)
Figure 1D:
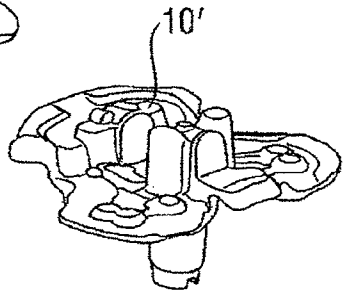
Fig. 1d (Prior Art)
Figure 1E:
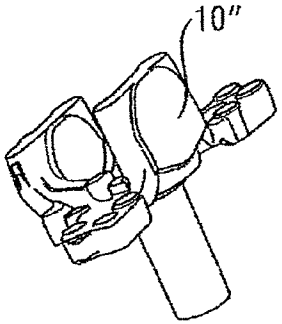
Fig. 1e (Prior Art)
Figures 2A, 2B, 2C, 2D, 2E, 2F:
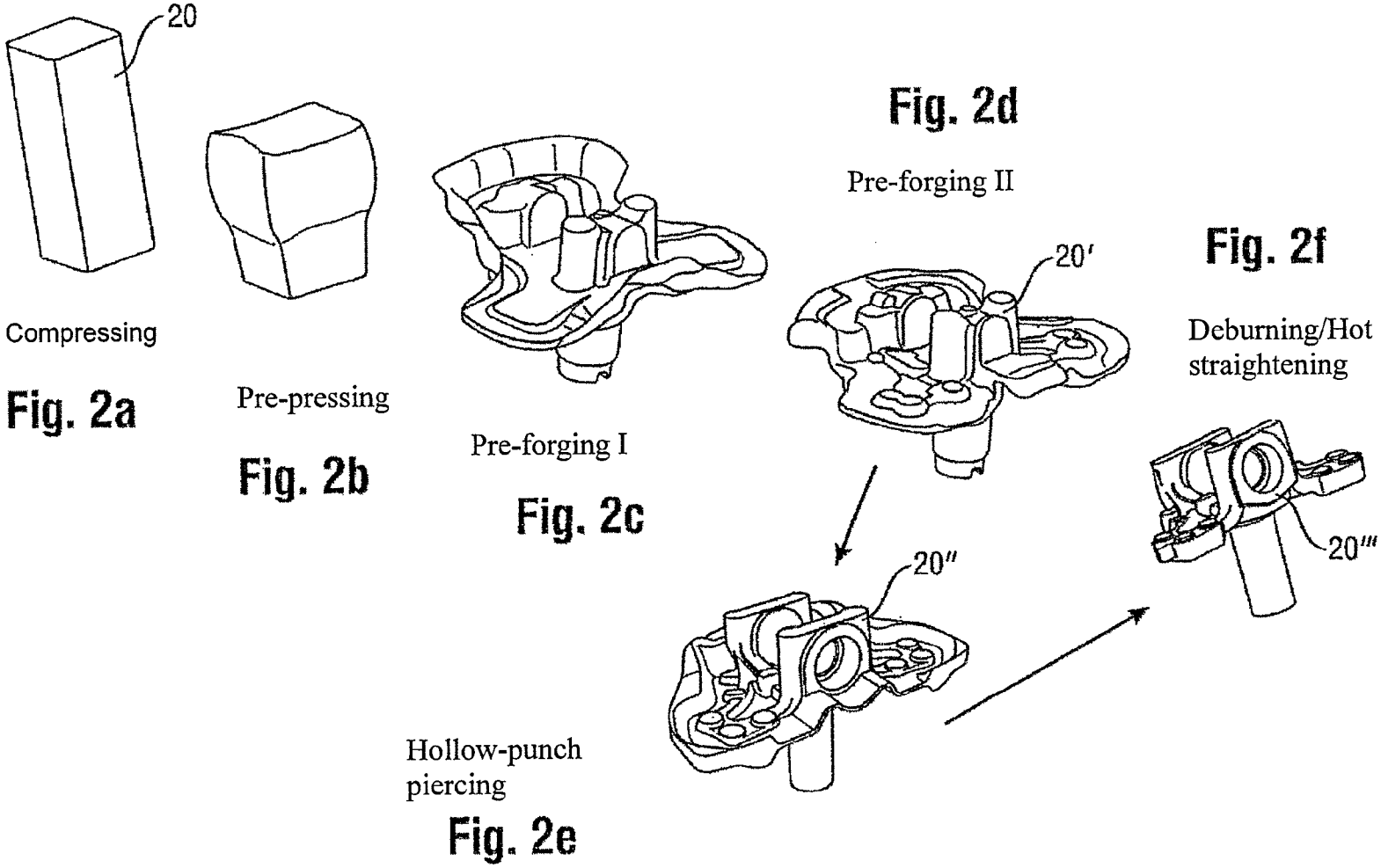
FIG. 2 schematically shows an example of the method according to the invention for producing forged parts having a pre-given end contour, also using the example of a steering knuckle.
Figure 3B:
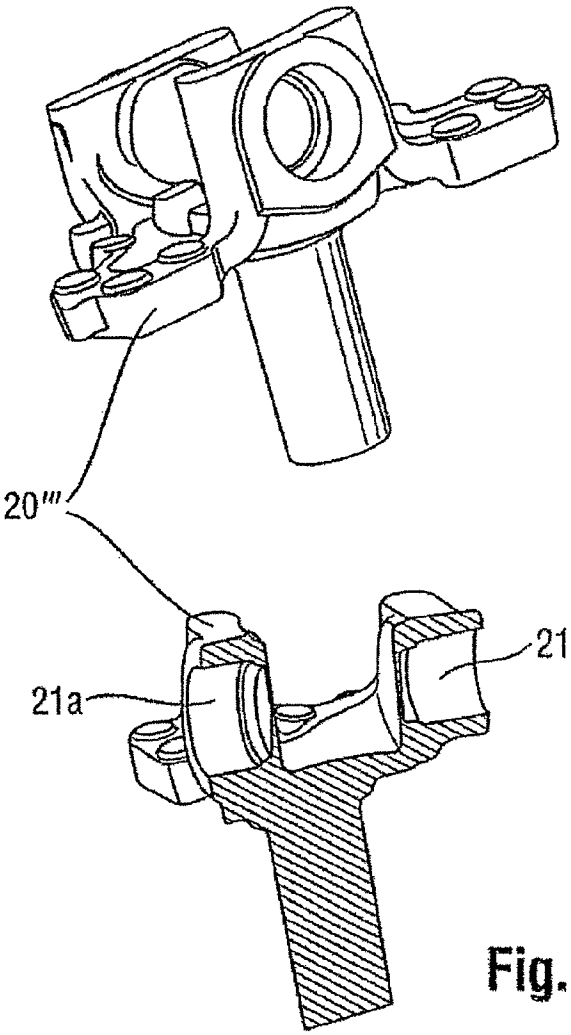
FIG. 3 shows a comparison of a conventionally produced steering knuckle and a steering knuckle produced according to the invention, both as a perspective view and as a radial section through the bearing seats.

In FIG. 2, in comparison with the conventional method of FIG. 1, the course of an exemplary method is presented for producing forged parts according to the invention, again using the example of the truck steering knuckle. As in the prior art, a blank 20 is first compressed, pre-pressed and pre-forged in two steps (FIG. 2*a* to *d*) to essentially approximate the outer contour of the finished forged part. Unlike in the prior art, however, after pre-forging (i.e. in the present case following the second pre-forging step) while the blank 20' is still essentially at forging temperature, the forming of the forged part is carried out in a die, the die cavity of which defines the outer contour of the pre-given end contour of the component. In the case of the steering knuckle during the forming process, that is the closing of the die, a hollow punch of each of the front and rear steering knuckle sides is inserted into the half-finished forged part 20' and in this way the hollowed-inward bearing seats 21*a* and 21*b* (FIGS. 2*e* and 3*b*) are formed. The hollow punches have precisely the shape and dimensions of the bearing seat to be formed. Only after that is the forging waste situated in the forging level removed by deburring/hot straightening, with the deburring or hot straightening, however, no longer being necessary to generate the complete end contour and thus, owing to the essentially lower amount of material removed, this takes much less time than the deburring or hot straightening in the prior art (cf. FIG. 1*e*). This time gain is also not cancelled out by the additional step of forming ("hollow-punch piercing") (FIG. 2*e*) as compared to the prior art. On the contrary, the additional forming step of "hollow-punch piercing" saves additional machining to form the bearing seats.

Figure 3A:
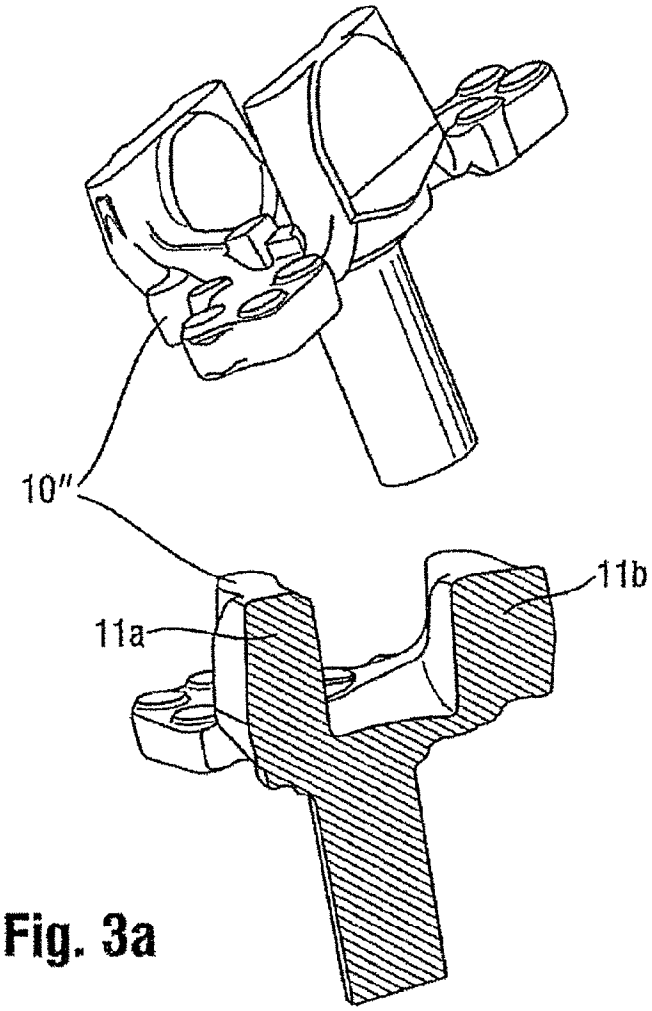

In FIG. 3, a perspective and sectional view show a comparison between the completed forged and deburred components. As is evident from FIG. 3*a*, the completed forged blank 10' produced with the conventional method does not yet comprise any recesses for the bearing seat, and the corresponding side portions 11*a* and 11*b* are solid. Accordingly, the weight of the conventionally produced steering knuckle is 32 kg. In contrast to this, the truck steering knuckle produced according to the invention already has the recesses for the bearing shells and they therefore no longer need to be produced by means of machining producing waste material. The weight of the completed forged raw part is 29 kg, which is also correspondingly lower. Not only can about 10% of material thus be saved but essentially shorter processing times can also be achieved.

Figure 4:
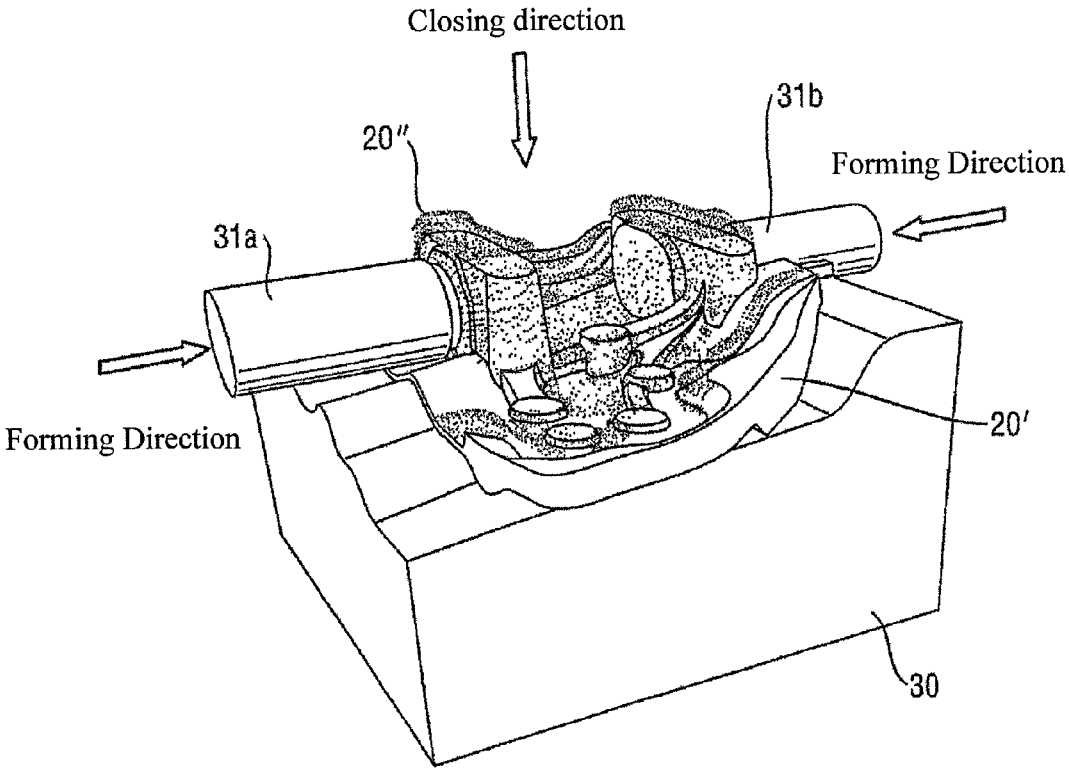
FIG. 4 shows a perspective view of a lower die half with the deposited blank to illustrate the forming direction and the end contour filling during the forming process.

In FIG. 4, a perspective view is shown of a die employed with the method according to the invention, with only the lower die half 30 being shown in the interest of comprehensibility. Here the intermediate product 20' produced in the second step of pre-forging (FIG. 2*d*), which is not yet essentially at forging temperature, is deposited into the die 30 and the die is closed by lowering the upper die half (not shown) (see arrow: "closing direction" in FIG. 4). Simultaneously, hollow punches 31*a* and 31*b* are pushed from two directions (see "forming direction" arrows) into the sides of the half-finished forged part 20', which form the bearing seats in the completed forged truck steering knuckle 20'". Here, the two forming directions opposing each other are located perpendicular to the closing direction of the die. Due to the still high temperatures from the preceding forging process, the entire die shape, i.e. the predefined end contour, is completely filled in owing to the material displaced by the hollow punches 31*a* and 31*b*. This is shown by the shaded outlines of the forged part 20". In other words, during the forming according to the invention, the material flows into the initially empty die spaces on the die inner surfaces until the die shape is filled. Here, preferably at the beginning of forming, slightly more material is available in the die than is necessary volume-wise for the final forged part. During subsequent displacement of the material owing to the insertion of the tool/tools, this also flows into the burrs at the die edges and thus always ensures a reliable, complete filling of the die.

Figure 5:
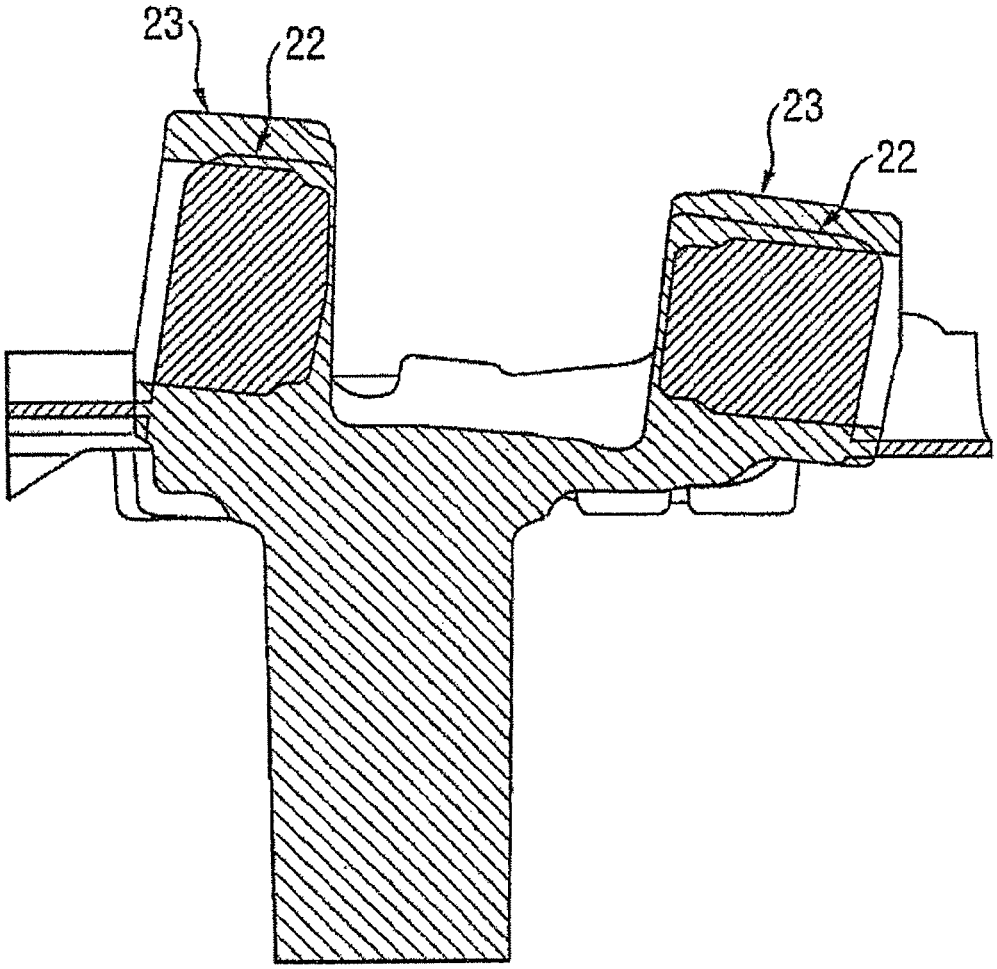
FIG. 5 shows a radial section through a steering knuckle produced according to the invention, the illustration of the steering knuckle after forging and the illustration of the steering knuckle after forming having been superimposed to emphasize the filling of the contour.

The savings in raw material achieved by the method according to the invention are especially evident from the sectional drawing of FIG. 5. Reference numeral 22 designates the forged contour produced after the second pre-forging (FIG. 2*d*), whereas reference numeral 23 designates the end contour after the forming process according to the invention, that is after inserting the hollow punches. By inserting or pushing in the hollow punches, the outer end contour 23 pre-given by the die 30 is thus filled, starting from the forged contour 22. In other words, the proportion of volume of the inserted hollow punch fills the die starting from the pre-forged, smaller forging contour 22 up to the prescribed end contour 23.

The invention claimed is:

1. A method for producing a steering knuckle of a commercial vehicle with a pre-given end contour, comprising:

pre-forging a blank at a forging temperature, to which the blank is heated, to obtain a pre-forged steering knuckle having an outer contour, wherein the outer contour of the pre-forged steering knuckle is smaller than the pre-given end contour of the steering knuckle, and subsequent forming of the pre-forged steering knuckle in an additional die, wherein, initially, the additional die is not completely filled by the pre-forged steering knuckle and includes initially empty die spaces, wherein forming is carried out while the pre-forged steering knuckle is still essentially at the forging temperature of the pre-forging, wherein during forming the additional die is closed, one or plural tools are inserted into the pre-forged steering knuckle and the material of the pre-forged steering knuckle is displaced and thereby completely fills the initially empty die spaces in the additional die from the inside such that the pre-given end contour of the steering knuckle is obtained.

2. A method according to claim 1, wherein at the beginning of forming in the additional die, more material is available in the die than is necessary volume-wise for the steering knuckle of the commercial vehicle.

3. A method according to claim 1, wherein the forming of the pre-forged steering knuckle in an additional die comprises forming secondary formed elements of the steering knuckle, namely bearing seats, by means of the tool or tools.

4. A method according to claim 1, the tool or tools determining a forming direction, and the die having a closing direction, wherein the forming direction/directions determined by the tool or tools is/are essentially perpendicular to the closing direction of the die.

5. A method according to claim 1, wherein the additional die defines the pre-given end contour of the steering knuckle.

6. A method according to claim 1, comprising subjecting the steering knuckle to a deburring or hot straightening step following the additional forming.

* * * * *